United States Patent [19]

Hinzpeter et al.

[11] 4,253,811

[45] Mar. 3, 1981

[54] METHOD OF AND A DEVICE FOR SORTING PELLETS UPON THEIR MOLDING IN A PREFORMING PRESS

[75] Inventors: Jürgen Hinzpeter; Ingo Schmidt, both of Schwarzenbek; Konrad Friedrichs, Sinzig, all of Fed. Rep. of Germany

[73] Assignee: Firma Wilhelm Fette GmbH, Schwarzenbeck, Fed. Rep. of Germany

[21] Appl. No.: 43,303

[22] Filed: Jul. 13, 1979

[51] Int. Cl.[3] ..... B30B 11/00

[52] U.S. Cl. ..... 425/149; 264/149

[58] Field of Search ..... 425/149; 264/40.5

[56] References Cited

U.S. PATENT DOCUMENTS

| | | | |
|---|---|---|---|
| 3,255,716 | 6/1966 | Knoechel et al. | 260/40.5 |
| 3,734,663 | 5/1973 | Holm | 425/149 |

*Primary Examiner*—James H. Derrington

*Attorney, Agent, or Firm*—Michael J. Striker

[57] ABSTRACT

A sorting device for use in connection with a preforming press having a rotary die disk and a punching station cooperating with the disk to mold pellets, includes an electromagnetically operated guiding partition movable between a lower deviating position and an upper pellet passing position; an electronic measuring circuit for measuring the maximum compressing force exerted by the punch; an electronic control circuit for evaluating the applied compressing force and for activating the guiding partition; a first proximity switch cooperating with the punch for activating the control circuit at the moment of application of the compressing force and an electronic time-setting circuit activated by a second proximity switch and cooperating with the control circuit to adjust the instant of activation of the latter in response to the speed of the die disk and to the actual position of a complete pellet relative to the deviating partition.

5 Claims, 5 Drawing Figures

METHOD OF AND A DEVICE FOR SORTING PELLETS UPON THEIR MOLDING IN A PREFORMING PRESS

BACKGROUND OF THE INVENTION

This invention relates generally to the sorting of pellets manufactured in a preforming press, and more particularly this invention relates to a method of and a device for the sorting of pellets molded in the preforming press having a rotary die disk, a punching station and means for measuring the compressing force applied on the pellets during the molding process, and means for selectively guiding the completed pellets off the disk in response to an actuation signal from the measuring means.

Preforming presses are known in which the manufacturing of pellets takes place in dies arranged around the periphery of a rotary die disk and in which a powdered material to be molded is compressed by punches. In order to preserve a predetermined quality of all pellets during the molding processes, the forces applied by the punches in respective dies are continuously measured and compared with nominal values. If the ascertained compression force applied against a pellet is above or below a range defined by two limit nominal values, the resulting pellet has to be discarded. For this purpose, an ejecting device is used which is located downstream of the punching station and is selectively actuated in response to the approach of a bad or good pellet. The control of this ejecting device in prior-art presses is effected by means of signals which upon actuation of a first punch proximity switch are generated by a compression force monitoring unit and fed into a shift register.

Such prior-art methods and devices, however, have the disadvantage that they can operate only at a very low sorting frequency which is unsuitable for high speed preforming presses. The term "sorting frequency" means the number of possible sorting processes carried out by the device in a time unit such as a second, for example. This low sorting frequency results principally from the fact that in prior-art sorting devices there is no possibility to shift the time point of actuation of the sorting elements in response to the manufacturing rate or speed of the preforming press.

Conventional sorting devices operate at a sorting frequency of about 30 Hertz (Hz), which means 30 possible working cycles per second. In high performance preforming presses of recent design, however, it is possible to manufacture as many as about 80 pellets per second.

SUMMARY OF THE INVENTION

It is, therefore, a general object of the present invention to overcome the aforementioned disadvantages. More particularly, it is an object of the invention to provide a method of and a device for sorting pellets in presses of the above-described type which in comparison with prior-art sorting devices can operate at substantially higher sorting frequencies.

In keeping with these objects, and others which will become apparent hereafter, one feature of the invention resides, in a sorting device cooperating with a preforming press of the above-described type, in the provision of a second proximity switch activated by the punch and cooperating with an electronic actuation time-setting circuit for the pellet ejecting device which activates the latter in response to the rotary speed of the die disk and to the position of a die relative to the ejecting device. The ejecting device according to the invention includes a guiding partition in the form of a vertically movable deviation guiding element such as a metal sheet partition which is movable from above between two consecutive pellets orbiting on the rotary disk to discharge a non-standard pellet into a waste channel. Upon the deviation of the trailing pellet from the rotary disk the deviation guiding member is lifted again to its starting position. The sinking and the lifting of the guiding element is effected preferably by means of a solenoid. The instant of energization of the solenoid is shifted in time in response to the rotary speed of the die disk or to the rate of the pressing strokes or to the rate of revolutions. If the rotary speed of the disk is relatively high, so the time point of actuation of the ejecting device is adjusted such that the sinking of the guiding partition be started at a moment at which the pellet preceding the pellet to be ejected is still below the guiding partition. If, however, the die disks rotate at a lower speed, the actuation of the solenoid for lowering the guiding partition to eject the subsequent pellet takes place at a time point at which the preceding pellet has already passed the range of the guiding partition. In this manner it is prevented that at a lower rotational speed of the die disk the leading or preceding pellet is damaged by the impact of the guiding partition. When the rotary speed of the disk or the rate of compressing strokes is increased, the guiding partition is prevented from taking its lowermost position (Ut) before a bad pellet has arrived.

According to this invention these advantages are made possible by the fact that the control pulse generated by a compression force monitoring unit (formed as an electronic logic circuit connected to a shift register), when a bad pellet is detected is not employed immediately for controlling the solenoid of the ejector but is applied first to an actuation time-setting circuit which releases the control pulse signal only upon a certain time delay depending on the molding or compressing frequency which is determined and applied to the time-setting circuit by means of the second proximity switch. In addition, the actuation time-setting circuit takes into account also the time of inertia which occurs during the operation of the ejection device. In order to make the time effect of inertia as short as possible, it is advantageous when the moving mass of the ejection device is kept at a minimum. For this reason and according to another feature of this invention, the guiding partition of the ejector is made of titanium. To further reduce the mass of the guiding partition, the latter is provided with a plurality of lightening holes. An improved rigidity of the guiding partition is achieved by one or more reinforcing fins or seams.

The connection between the guiding partition and the solenoid is made preferably by means of a rod which is connected to the movable armature of the solenoid.

The control of the ejection device by the electronic actuation time-setting circuit is adjusted in such a manner that in the case of a small rotational rate of the die disk or of a low compression frequency the guiding partition remains in its lower or deviating position (Ut) for a longer time interval than in the case of high rotational speeds of the die disk. In this manner, the actuation time-setting circuit matches not only the instant of actuation of the solenoid to the rotational speed of the die disk but also the duration of respective working cycles of the ejecting device. Each cycle includes at least the lowering and lifting of the guiding partition and in addition a delay of the guiding partition in its lowered operative position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
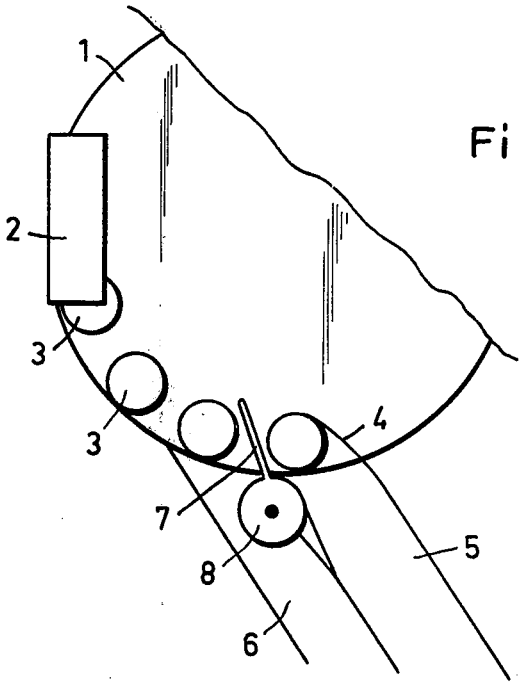
FIG. 1 is a top view of a cut-away portion of a preforming press including a pellet-ejecting device.

FIG. 1 illustrates in a top view a rotary die disk 1 and a stationary pellet pressing station 2 including non-illustrated punches cooperating with respective dies in the disk 1 to form the pellets 3. Compressing forces exerted by the punches during the molding of each pellet 3 are measured. If the completed pellets are molded under predetermined compression forces without defect, so they are permitted downstream of the pressing station 2 to reach a wiper 4 which guides them off the die plate 1 into a discharge channel 5. If, however, the measurement indicates that the completed pellets are defective so these bad pellets are selectively guided into a waste channel 6. For this purpose there is provided a vertically movable guiding partition 7 which is operatively connected to a solenoid 8 which controls its operative and inoperative position. In other words, by means of the solenoid 8 the guiding partition is introduced between two successive pellets 3 in such a manner that without touching the leading pellet it guides the successive bad pellet into the waste channel 6.

Figure 2:
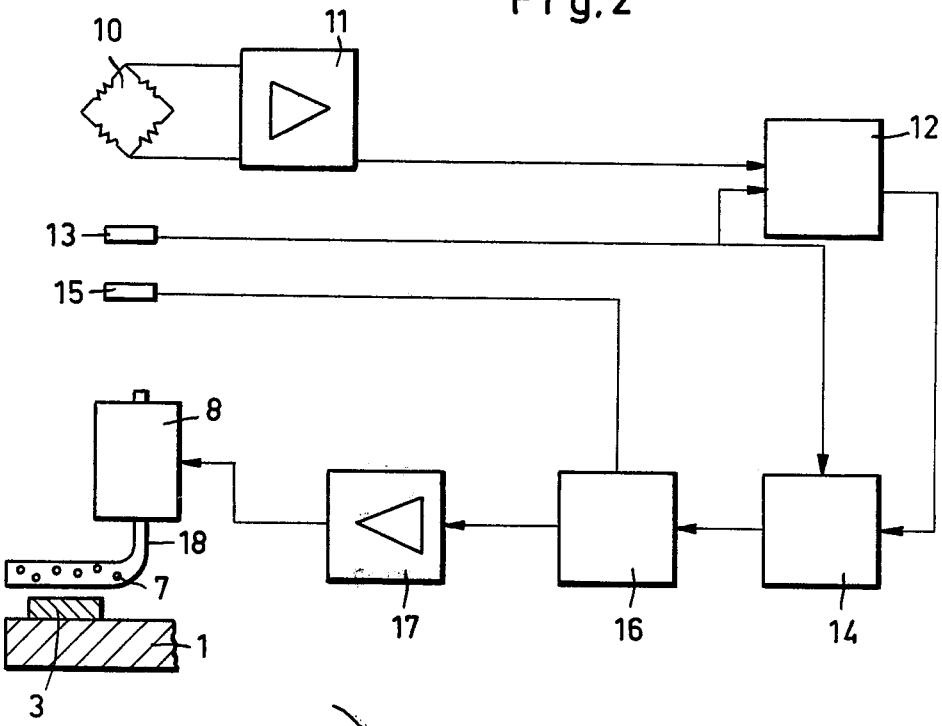
FIG. 2 is a schematic circuit diagram of electronic measuring and control devices for controlling the operation of a pellet ejecting mechanism.

FIG. 2 shows a schematic diagram of an electrical measuring circuit for the compressing forces and cooperating circuitry for controlling the solenoid 8. The compression force of the punches in pressing station 2 is measured at a measuring point by means of extension measuring strips connected in a bridge. The measuring point 10 is connected to the input of a measuring amplifier 11, the output signal of which is applied to a compression force monitoring circuit 12 formed of electronic logic modules which process the signal corresponding to the measured compression force by comparing the same with two adjustable nominal limit values. The evaluating operation of the logical modules in the monitoring circuit 12 is initiated by a first punch proximity switch 13 which delivers an actuation signal when maximum compressing force is applied by the punch against the molding material. The first proximity switch 13, therefore, delivers an exact time point at which the maximum compressing force is exerted on each individual pellet. In addition, the first proximity switch 13 performs the function to apply a shift pulse to a shift register 14 which is connected to the output of the compression force monitoring circuit 12. In other words, the first proximity switch 13 determines the time point at which the shift of states in the shift register 14 takes place and an output signal from the register 14 is generated.

This output signal from the register 14 is applied to an electronic actuation time-setting circuit 16 which is also connected to a second punch proximity switch 15. The second proximity switch 15 delivers to the time preparation circuit 16 a signal which exactly determines the beginning of the timing action and the length of the time delay for passing an output signal. This time delay is determined by the operational frequency of the press or by the rotational speed of the die disk.

The second punch proximity switch 15 is arranged relative to the punch in station 2 in such a manner as to generate a signal as soon as the approaching punch reaches a predetermined distance from the die and to keep this signal that long until the moving punch exceeds a predetermined distance. The duration of this signal is, therefore, a function of the rotary speed of the die disk or of the speed of the punch. In other words, if this signal from the second proximity switch 15 is relatively long, this condition indicates that the preforming press operates slowly. In this event, a time delay value "X" becomes larger, as it will be explained below. In practice this value "X" in one example is adjusted to be three times as long as the length of the signal from the second punch proximity switch 15. This adjustment is made in order to obtain a more favorable relationship to another value "W" indicating the relatively short time of inertia of the ejecting device. In this adjustment it is also to be taken into account the fact that the so-called damping time, that is the duration of the signal generated by the second proximity switch 15, is in practice even shorter than the value "W". Inasmuch as the value "X" has to be larger than the value "W", the value "X" has been selected to be three times longer than the duration of the signal of the second proximity switch 15. Such an application of the switch signal, however, is unnecessary when the preforming press operates relatively slowly since in such a case the time of damping or the duration of the signal from the switch 15, is relatively long. As mentioned above, the actuation time-setting circuit 16 is connected at one input thereof to the second proximity switch 15 and has a second input connected to the shift register 14. Respective signals from the switch 15 and from the register 14 cooperate with each other in the circuit 16 to release an actuation signal at the output of the circuit 16 which is amplified in a power amplifier 17 to activate at a time point C, the solenoid 8 of the ejecting device.

Figure 3:
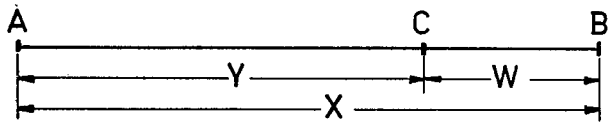
FIG. 3 is a time plot of a pellet ejecting action.

The mutual relations of different time points and time intervals are illustrated in the diagram in FIG. 3.

In this diagram, A denotes the time point of release of the actuation time-setting circuit 16, B denotes the time point at which the guiding partition 7 of the ejecting devices reaches its lower or sorting position, C denotes the time point at which the solenoid 8 is energized, X denotes a time delay depending in reverse proportion on the working frequency of the punch or on rotational speed of the die disk, the value X being arbitrarily determined within certain limits, W denotes the time of movement or the time of inertia of the ejecting devices 7 and 8, which value is a constant, such as for example 5 milliseconds, and Y denotes X-W, that means the time period from the time point A to the time point C.

The dime delay value X is derived from the following formula:

$$X = \frac{F \cdot S}{D \cdot \pi \cdot \frac{\text{rotations}}{\text{per second}}}$$

in which:

S=a selected length of travel of the punch indicated for example by divisions in millimeters of a punch travel dial and corresponding to the damping time the measurement of which is initiated by the second proximity switch 15 actuated by the punch;

F=a multiplication factor, for example 3, by which the damping time is increased;

D=the diameter of the punch travel dial in millimeters; and rotations per seconds=the rotational speed of the die disk.

The above-mentioned equation expresses the dependency of the total time delay X on the graduation of a punch travel dial, on the diameter of this dial and on the rotary speed of the die disk whereby the graduation and the diameter of the punch travel dial remains constant for all pressure measurements so that the rotary speed is the sole variable. It can be seen from the equation that the value X is the smaller the larger is the rotary speed. Furthermore, the equation reveals that the number of revolutions or the rotational speed of the die disk, the time multiplication factor F and the time of inertia W are the data which are processed in the actuation time-setting circuit 16. A continuous assertion of the rate of rotation of the disk in the exemplary embodiment of FIG. 2 is effected by the second proximity switch 15, the damping time period of which ($\frac{1}{3}$.X) is a measure for the rotational rate of the die disk. The damping time period initiated upon the actuation of the switch 15 by the punch approaching the die, activates an oscillator and the pulses generated by the oscillator are counted in a counting register. The counting register upon completing its count upwardly at the frequency of the oscillator starts counting downwardly at one-third of the oscillator frequency. In doing so, the counting register reaches its zero state upon a time period which corresponds to the triple damping time as measured by the proximity switch. As it has been already indicated, the ejecting devices 7 and 8 has to be released in advance about a time period W corresponding to the time of its inertia. For this reason, the time interval W is subtracted from the triple damping time X. Accordingly, in the illustrated example the ejecting device 7 and 8 is not released immediately upon the attainment of the zero state in the counting register in the circuit 16, but only upon the attainment of a preselected count corresponding to the time of inertia of this movable sorting partition 7. This additional count is selected by means of separate coding switches. Once the ejecting device 7 and 8 is brought in its ejecting position Ut so it remains in this position so long until the next good pellet arrives. For this reason, the preparation of the timing for this upward movement of the guiding partition 7 from its lower or ejecting position Ut into its upper or passing position Ot has to be made in dependency on the rotary speed of the die disk while simultaneously taking into account the inertia of the movable ejecting partition 7. The determination of the rotational rate of the disk is again the same as described above. Also the time of inertia W of the ejecting device is subtracted and the release pulse actuates logic circuits so as to move the guiding partition from its low ejecting position Ut to its lifted passing position Ot. In the preferred embodiment, solenoid 8 used in the ejecting device for lifting and lowering the guiding partition 7 is a polarized turn-over lifting magnet or solenoid which has two fixed positions for its armature and uses two permanent magnets which hold the armature in one or the other fixed position. The armature is guided for movement in a coil disposed between the both permanent magnets. By exciting the coil the armature is pulled towards one end position and held by the assigned permanent magnet. A rod 18 connects the guiding partition 7 to the armature of the solenoid 8. Upon the reversal of the polarity the armature is pulled into the other end position and held by the other permanent magnet.

Figure 5:
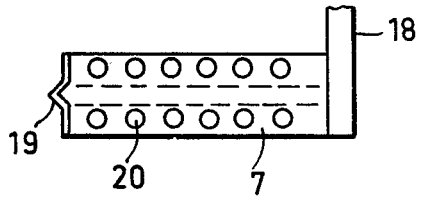
FIG. 5 is a side view of a guiding partition in the ejector according to this invention.

In order to reduce the mass of the vertically movable guiding partition 7 which is preferably made of titanium, the latter is provided with lightening holes 20 and with a reinforcing fin 19, as illustrated in FIG. 5.

Figure 4:
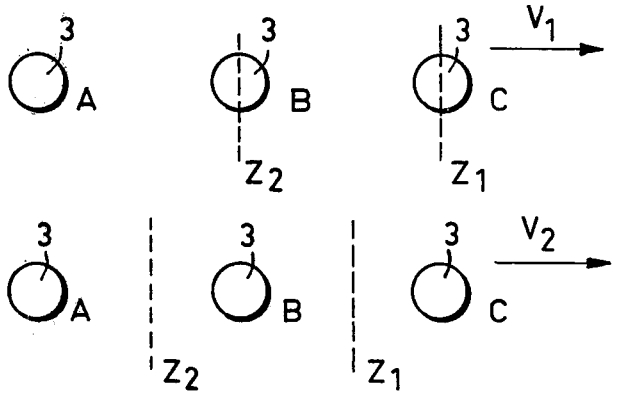
FIG. 4 shows schematically the time sequence of two different pellet ejecting processes.

FIG. 4 schematically illustrates the differences in timing of the actuation of the ejecting device 7 and 8 in response to different rotational rate or rotational speed of the die disk. In the first case as illustrated on the upper line in FIG. 4, the die disk rotates at a high rotational speed $V_1$ and consequently the lowering of the guiding partition 7 takes place at a time point $Z_1$ during which the leading pellet C is still present below the guiding partition 7. After the lower partition 7 has deviated the following bad pellet B the partition 7 starts lifting again at a time point $Z_2$ at which the die pertaining to the bad pellet B is still in the range of the partition 7.

In the second case as illustrated on the lower row in FIG. 4, the rotational speed $V_2$ of the die disk is substantially smaller than in the preceding case and consequently the sinking of the guiding partition 7 initiates at a time point $Z_1$ at which the leading pellet C has considerably advanced past the range of the sinking partition 7. The upward stroke of the partition takes place at the time point $Z_2$ at which the die of the deviated bad pellet B has also advanced considerably past the range of the upwardly moving partition 7. At a high operational speed or at a high operational frequency of this preforming press as shown in the first example, there is introduced a longer time delay between the actuations of the ejecting device since the lowering and lifting of the guiding partition 7 takes always the same time. On the other hand, in the second case when the operational speed of the press is low the retention time of the deviating partition 7 in its low position is longer than at high operational speed of the press. In this manner the failure of the guiding partition to deviate a bad pellet in the case of an extremely low rotational speed of the die disk is prevented. A novel feature of this invention, therefore, is also in the shift of the beginning of the retention time of the guiding partition in its low position in response to the rotational rate of the disk. As can be recognized from the example of FIG. 4, the arrangement of this invention automatically advances the actuation moment of the solenoid of the ejecting device when high rotational speeds or high operational frequency is attained. In other words, the actuation time point for the solenoids is determined in response to the rotational rate of the die disk relative to the position of an advancing die.

It will be understood that each of the elements described above, or two or more together, may also find a useful application in other types of constructions differing from the types described above.

While the invention has been illustrated and described as embodied in an ejecting device for preforming presses, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a preforming press having a rotary die disk, a punching station having punching means cooperating with said disk to mold pellets in said die disk within a predetermined range of compressing forces, and a device for sorting the completed pellets, said sorting device comprising means for measuring the compressing force exerted by said punching means during the molding process; pellet ejecting means arranged in the range of said disk downstream of said punching station, said pellet ejecting means including a solenoid and a guide partition operatively connected thereto; an electronic measuring circuit for evaluating the applied compressing force to measure the quality of the resulting pellet; a first proximity switch cooperating with said punching means for activating said measuring circuit at the moment of maximum compressing force; and an electronic control circuit for actuating said ejecting means, said control circuit including a time-setting circuit cooperating with said measuring circuit, a second proximity switch cooperating with said punching means to generate a signal the duration of which is a function of the speed of travel of said punching means and of the rotational speed of said die disk, said signal being applied to said time-setting circuit to determine the beginning of the activation of said control circuit in response to the speed of said die disk, said solenoid being activated by said time-setting circuit to thereby move said guide partition between a lower pellet ejecting position and an upper pellet passing position in response to said signal.

2. The sorting device as defined in claim 1, wherein said solenoid includes an armature connected to said guide partition by a connecting rod.

3. The sorting device as defined in claim 1, wherein said guiding partition is of titanium.

4. The sorting device as defined in claim 1, wherein said guide partition includes reinforcing fins.

5. The sorting device as defined in claim 1, wherein said guide partition includes weight-reducing holes.

* * * * *